US009777902B1

(12) United States Patent
Katterheinrich et al.

(10) Patent No.: US 9,777,902 B1
(45) Date of Patent: Oct. 3, 2017

(54) LIGHT FIXTURE WITH A SHADE AND A LIGHT SOURCE ASSEMBLY

(71) Applicant: TARGET BRANDS, INC., Minneapolis, MN (US)

(72) Inventors: Kent D. Katterheinrich, Shoreview, MN (US); Elizabeth Kern, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 38 days.

(21) Appl. No.: 15/144,404

(22) Filed: May 2, 2016

(51) Int. Cl.

| | |
|---|---|
| ***F21V 1/04*** | (2006.01) |
| ***F21V 17/12*** | (2006.01) |
| ***F21S 4/26*** | (2016.01) |
| ***F21V 23/00*** | (2015.01) |
| ***F21S 6/00*** | (2006.01) |

(Continued)

(52) U.S. Cl.
CPC *F21V 1/04* (2013.01); *F21S 4/26* (2016.01); *F21S 6/002* (2013.01); *F21S 6/005* (2013.01); *F21V 1/143* (2013.01); *F21V 17/12* (2013.01); *F21V 23/003* (2013.01); *F21Y 2103/003* (2013.01); *F21Y 2103/022* (2013.01)

(58) Field of Classification Search
CPC .. F21K 9/00; F21K 9/235; F21S 13/12; F21S 4/00; F21S 6/002; F21S 6/005; F21S 6/007; F21S 8/088; F21V 1/00; F21V 1/06; F21V 1/143; F21V 15/01; F21V 19/001; F21V 21/06; F21V 21/10; F21Y 2103/33; F21Y 2113/30
See application file for complete search history.

(56) References Cited

U.S. PATENT DOCUMENTS

| | | | |
|---|---|---|---|
| 1,384,578 | A | 7/1921 | Tomlinson |
| 1,982,204 | A | 11/1934 | Doane |

(Continued)

FOREIGN PATENT DOCUMENTS

| | | |
|---|---|---|
| DE | 102007050909 A1 | 5/2009 |
| GB | 586946 | 4/1947 |

OTHER PUBLICATIONS

"144 LED Bulb Microscope Ring Light Illuminator Adjustable Bright Lamp + Adapter", printed from www.ebay.com/itm/144-LED-Bulb-Microscope-Ring-Light-Illuminator-Adjustable-Bright-Lamp-Adapter-/161465313464, publicly available at least as early as Jul. 10, 2015 (4 pages).

(Continued)

*Primary Examiner* — Hargobind S Sawhney
(74) *Attorney, Agent, or Firm* — JoAnn M. Seaton; Griffiths & Seaton PLLC

(57) ABSTRACT

A shade for use with a light source assembly includes a frame ring, a coupling ring, at least two arms, and a trimming. The coupling ring is configured to be secured to the light source assembly and includes a first end and a second end opposite the first end. The coupling ring forms an open shape such that the first end and the second end are spaced from each other defining a coupling ring opening between the first end and the second end. The at least two arms each extend between the frame ring and the coupling ring to maintain the frame ring spaced from the coupling ring. The trimming is coupled to and extends around and away from the frame ring. The trimming is configured to at least one of direct light and diffuse light emitted from the light source assembly.

20 Claims, 10 Drawing Sheets

(51) Int. Cl.

| | |
|---|---|
| ***F21V 1/14*** | (2006.01) |
| *F21Y 103/00* | (2016.01) |
| *F21Y 103/02* | (2006.01) |

(56) References Cited

U.S. PATENT DOCUMENTS

| | | | | |
|---|---|---|---|---|
| 2,206,508 | A * | 7/1940 | Labuda | F21V 1/00 362/353 |
| 2,626,346 | A | 1/1953 | Stoller | |
| 2,683,800 | A * | 7/1954 | Tradelius | F21V 1/00 160/178.1 R |
| 2,713,632 | A * | 7/1955 | Fine | F21V 1/00 362/357 |
| 2,853,597 | A * | 9/1958 | Hartman | F21S 6/002 362/311.14 |
| 2,878,425 | A | 3/1959 | Kudoh | |
| 3,582,643 | A * | 6/1971 | Heise | F21V 1/00 362/356 |
| 4,237,523 | A | 12/1980 | Moote | |
| D259,961 | S | 7/1981 | Wotowiec et al. | |
| D261,049 | S | 9/1981 | Wotowiec et al. | |
| D261,050 | S | 9/1981 | Wotowiec et al. | |
| D261,057 | S | 9/1981 | Wotowiec et al. | |
| D261,058 | S | 9/1981 | Wotowiec et al. | |
| D261,059 | S | 9/1981 | Wotowiec et al. | |
| D261,060 | S | 9/1981 | Wotowiec et al. | |
| 4,727,461 | A * | 2/1988 | Naumoff | F21V 1/06 362/352 |
| D378,145 | S | 2/1997 | Cohon | |
| D388,529 | S | 12/1997 | Parker | |
| D401,004 | S | 11/1998 | Eusterbrock | |
| 5,920,643 | A * | 7/1999 | White | G01N 21/8806 362/249.04 |
| 6,122,048 | A * | 9/2000 | Cochran | G01N 21/8806 250/223 B |
| 6,280,065 | B1 | 8/2001 | Denningham | |
| 6,398,390 | B1 * | 6/2002 | Schacht | F21V 1/04 362/351 |
| 6,776,507 | B2 | 8/2004 | Chen | |
| D580,090 | S | 11/2008 | Kubler | |
| D580,580 | S | 11/2008 | Lodhie | |
| D589,645 | S | 3/2009 | Citterio | |
| 7,614,762 | B2 | 11/2009 | Tseng | |
| 8,287,161 | B2 | 10/2012 | Zhang et al. | |
| 8,360,611 | B2 | 1/2013 | Luo et al. | |
| 8,454,191 | B2 | 6/2013 | Chang | |
| 8,540,397 | B2 * | 9/2013 | Gill | F21S 8/086 362/147 |
| 8,550,655 | B1 | 10/2013 | Wang | |
| 8,616,739 | B2 | 12/2013 | Plunk | |
| 8,678,611 | B2 | 3/2014 | Chu et al. | |
| D709,235 | S | 7/2014 | Chu | |
| 8,858,032 | B2 | 10/2014 | Van De Ven et al. | |
| 8,876,331 | B2 | 11/2014 | Waring | |
| D718,892 | S | 12/2014 | Kim et al. | |
| 9,605,817 | B1 * | 3/2017 | Goldney | F21S 6/007 |
| 2002/0001193 | A1 * | 1/2002 | Osawa | F21S 4/00 362/249.14 |
| 2003/0189831 | A1 * | 10/2003 | Yoneda | F21K 9/00 362/294 |
| 2011/0163678 | A1 * | 7/2011 | Shew | F21S 6/002 315/159 |
| 2012/0206918 | A1 * | 8/2012 | Lee | F21S 2/005 362/249.02 |

OTHER PUBLICATIONS

"Big Dipper Arc Floor Lamp", printed from www.cb2.com/big-dipper-arc-floor-lamp/s126317?a=501&adpos...&device=c &matchtype=&network=g &gclid=CPHHg9u9jccCFQIEaQodsVcKrA, publicly available at least as early as Aug. 3, 2015 (2 pages).

"The Mother Board Lanboy Apocalypse", printed from www.motherboards.org/forums/viewtopic.php?t=119981, posted on Apr. 12, 2012 (20 pages).

"Spider Lamp Shade", printed from www.tustinelectrical.us/tag/spider-lamp-shade, publicly available at least as early as Nov. 20, 2015 (8 pages).

"Milton Green Star Sophia Arc Floor Lamp", printed from www.allmodern.com/Milton-Green-Star-Sophia-Arc-Floor-Lam... 1904226620&PilD%5B%5D=13579111 &gclid=CLXIzsy9jccCFQMbaQod8cEKQg, publicly available at least as early as Aug. 3, 2015 (5 pages).

"Make an Iron Man Arc Reactor", printed from www.instructables.com/id/Make-an-Iron-Man-Arc-Reactor/step4/Make-the-top-ring-assembly/, publicly available at least as early as Aug. 2009 (8 pages).

"LED Underwater Light, Submersible LED Light Ring, LED Garden Stick Light Supplier & Application Information", printed from www.mainlandmart.com/ledmart.html, publicly available at least as early as Aug. 3, 2015 (15 pages).

"The Ten-Minute Ring Light", printed from www.dansdata.com/ringlight.htm, posted on Nov. 1, 2007 (13 pages).

* cited by examiner

LIGHT FIXTURE WITH A SHADE AND A LIGHT SOURCE ASSEMBLY

CROSS-REFERENCE TO RELATED APPLICATION

This application is related to U.S. patent application Ser. No. 29/563,112, filed on May 2, 2016.

BACKGROUND OF THE INVENTION

Driven largely by environmental and efficiency concerns, light emitting diodes (LEDs) have become popular replacements for fluorescent, incandescent, and other light-generating devices. LEDs are characterized by a longer life span and higher energy efficiency than conventional light-generating devices but also emit light at greater spot intensities and produce higher levels of heat than conventional light-generating devices. In addition, since LEDs are generally smaller and do not make use of a typical light electrical socket, existing light fixture housings for receiving fluorescent or incandescent light-generating devices, the associated shades, and/or other accessories do not provide proper structure or electrical support to fully make use of LEDs or similar light-generating devices.

SUMMARY

One embodiment of the invention relates to a shade for use with a light source assembly includes a frame ring, a coupling ring, at least two arms, and a trimming. The coupling ring is configured to be secured to the light source assembly and includes a first end and a second end opposite the first end. The coupling ring forms an open shape such that the first end and the second end are spaced from each other defining a coupling ring opening between the first end and the second end. The at least two arms each extend between the frame ring and the coupling ring to maintain the frame ring spaced from the coupling ring. The trimming is coupled to and extends around and away from the frame ring. The trimming is configured to at least one of direct light and diffuse light emitted from the light source assembly. Other shades, light source assemblies, and methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the term "about" or "substantially" apply to all numeric values or descriptive terms, respectively, and generally indicate a range of numbers or characteristics that one of skill in the art would consider equivalent to the recited values or terms, that is, having the same function or results.

One embodiment of the innovation provides a light fixture with a light source assembly including multiple lighting strips facing in different directions to provide light in a substantially uniform manner and/or to selectively provide light directed in less than all of the different directions. The light source assembly is coupled to a support structure maintaining the light source assembly spaced from a floor, ceiling, wall, etc. In one example, a shade fits around the light source assembly to diffuse light emanating from the lighting strips. The shade includes a coupling ring with an open side configured to be selectively placed around the light source assembly without need for disassembly of the light source assembly from the support shaft and/or disassembly of the shade. In one embodiment, the light fixture is provided with visual aesthetics similar to conventional incandescent fixtures, but with the increased efficiencies of an LED or similar point light source.

Figure 1:
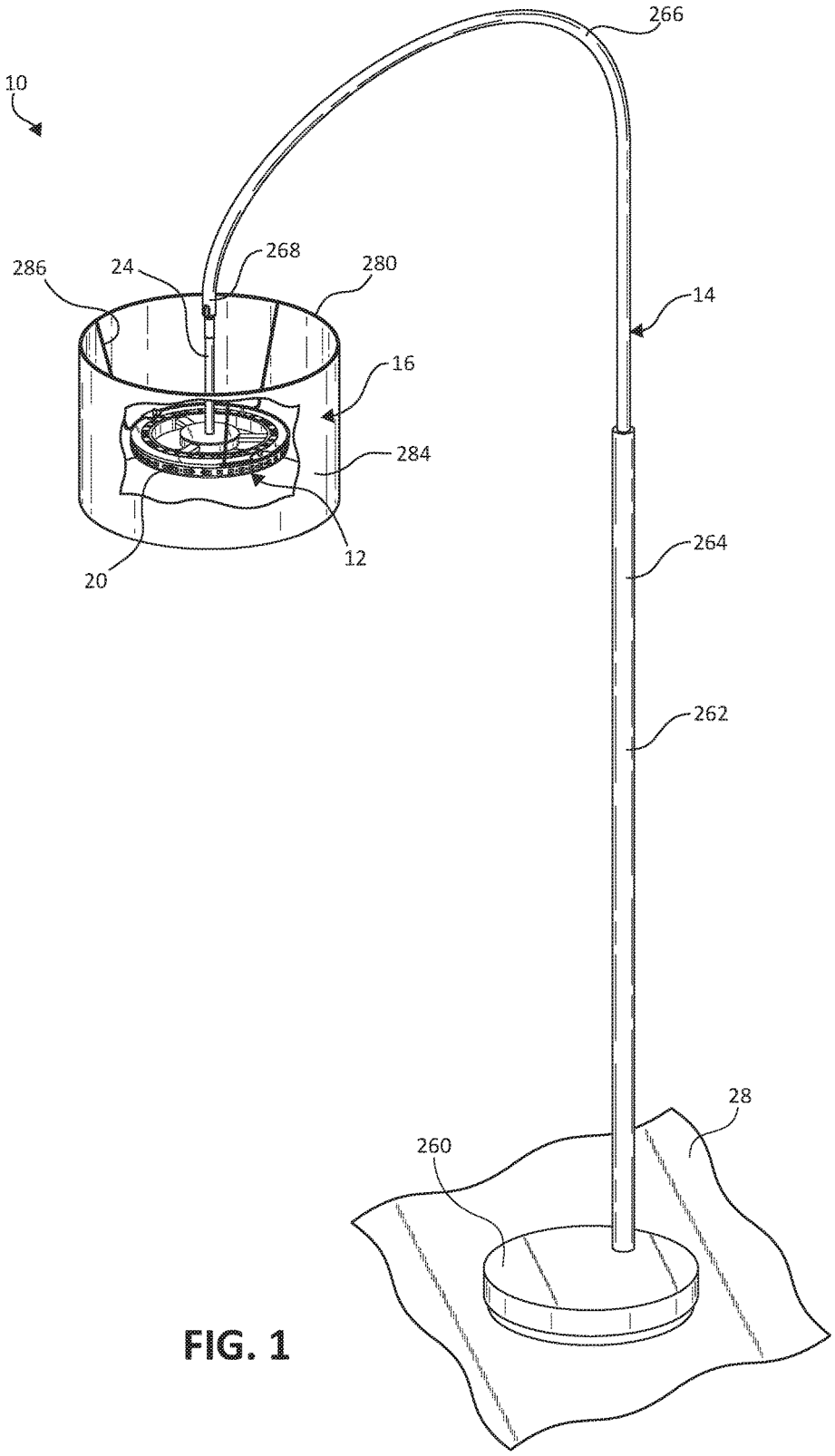
FIG. 1 is a front perspective view illustration of a light fixture, according to one embodiment of the present invention.

Turning to the figures, FIG. 1 illustrates one example of a light fixture 10 in the form of a floor or table lamp, including a light source assembly 12, a support structure 14, and a shade 16 extending around light source assembly 12. Additionally referring to FIG. 2, light source assembly 12 includes perimeter framework 20, a central hub 22, a shaft 24 extending from central hub 22, and a plurality of light strips 26. The plurality of light strips 26 are coupled to various surfaces of the perimeter framework 20 to provide illumination in a variety of directions providing a uniform light to a surrounding environment. Support structure 14 couples with shaft 24 of light source assembly 12 to support light source assembly 12 above a floor 28 (FIG. 1) or other environmental support, while shade 16 provides aesthetic appeal to light fixture 10 while diffusing light emanating from the plurality of light strips 26.

Figure 2:
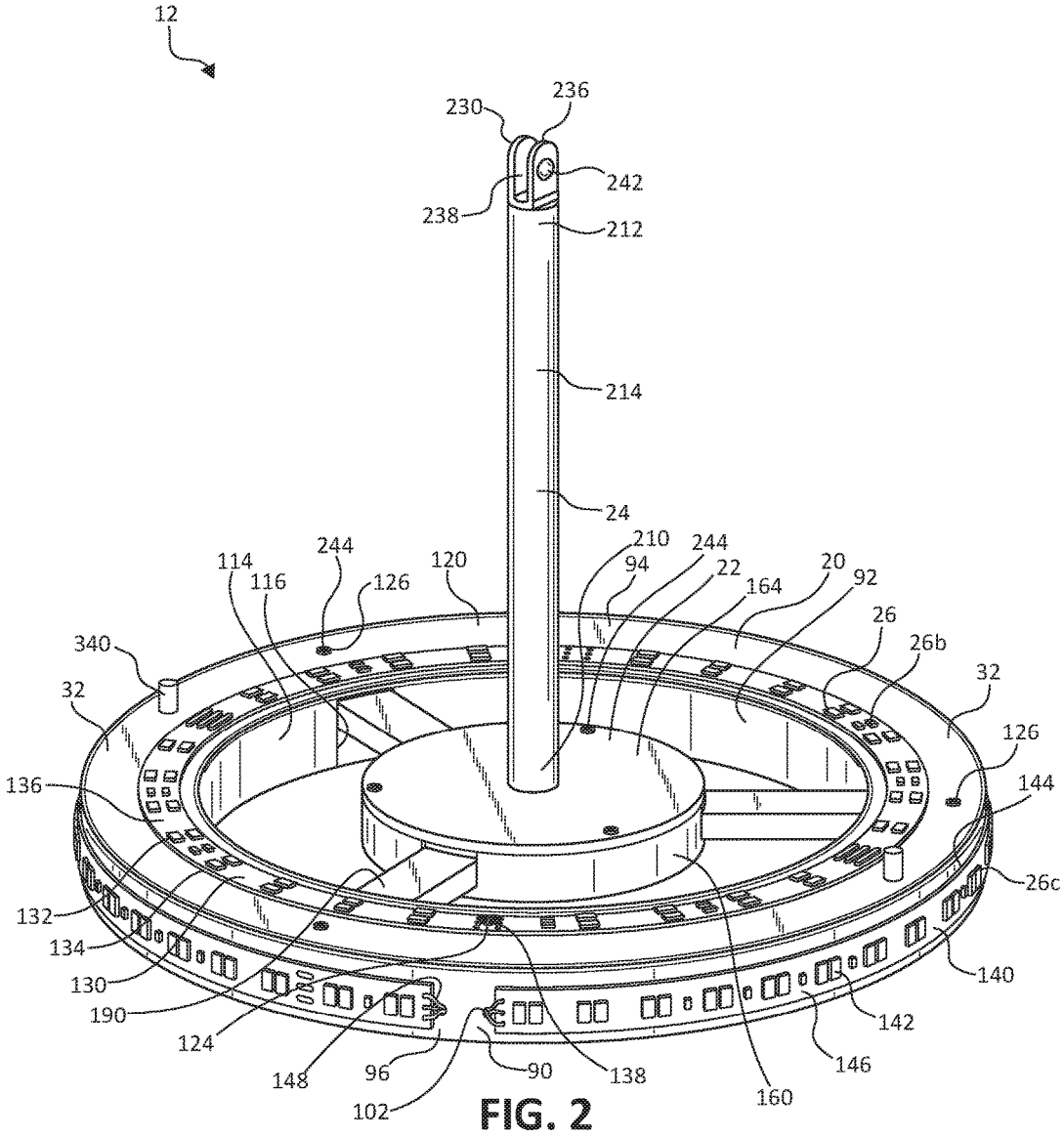
FIG. 2 is a front perspective view illustration of a light source assembly of the light fixture of FIG. 1, according to one embodiment of the present invention.
Figure 3:
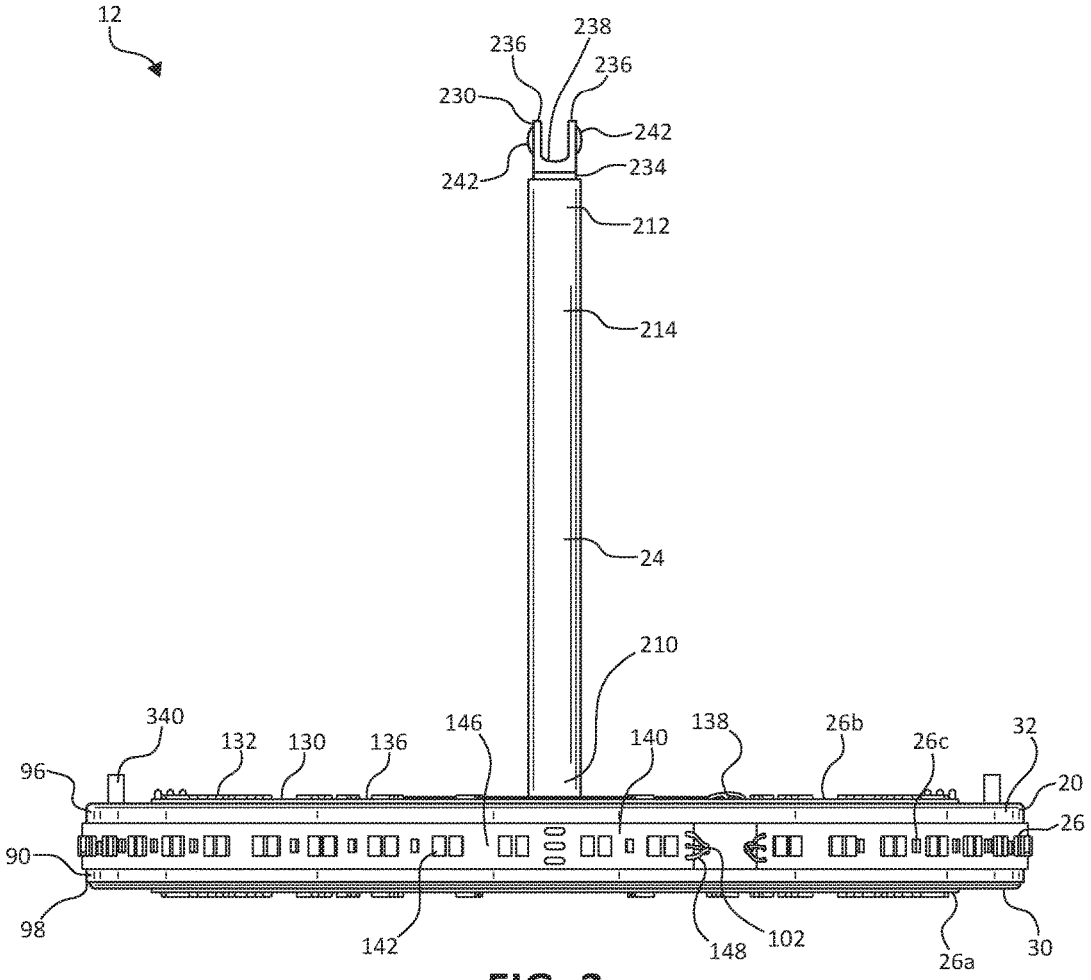
FIG. 3 is a front view illustration of the light source assembly of FIG. 2, according to one embodiment of the present invention.
Figure 4:
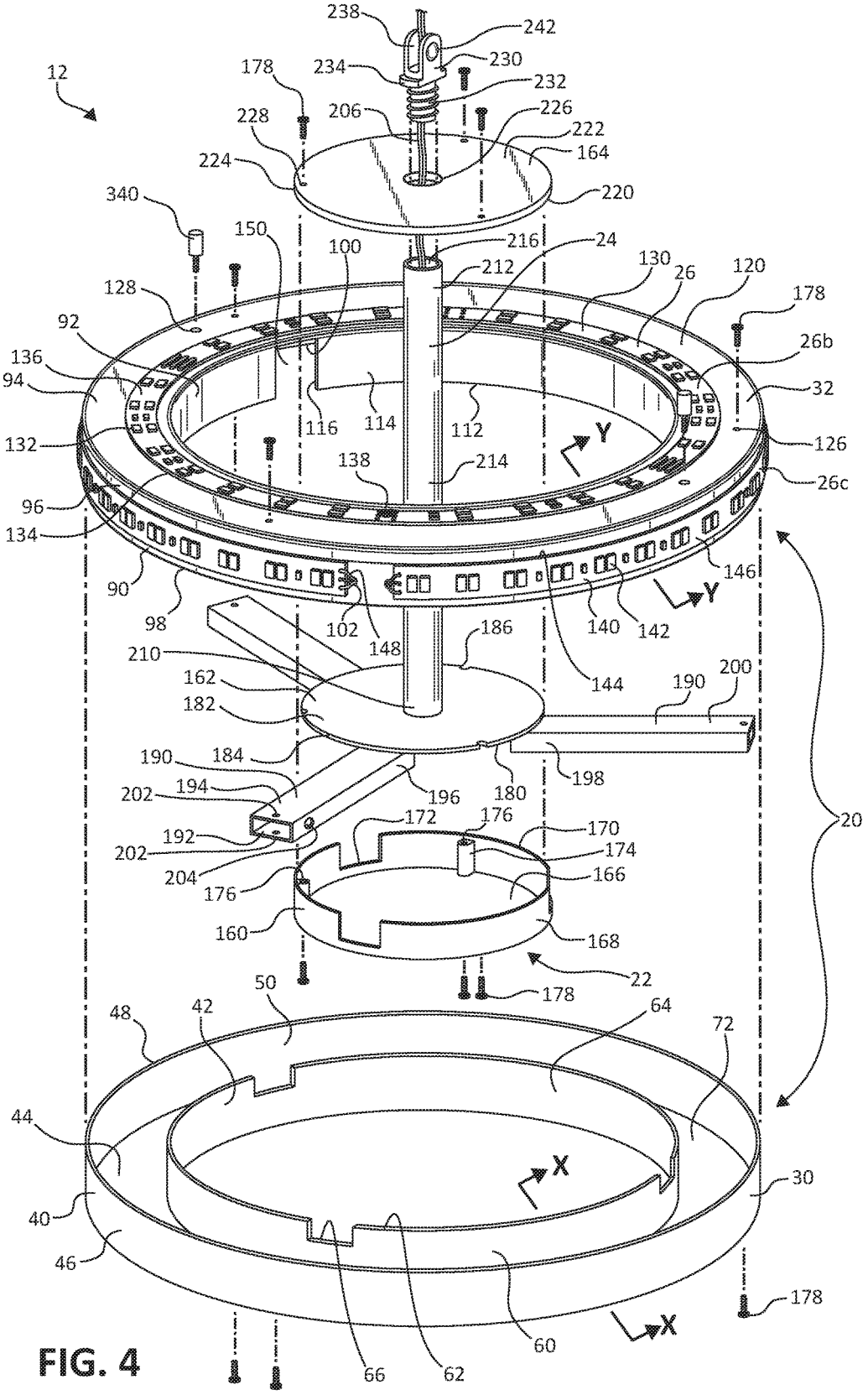
FIG. 4 is an exploded, front perspective view illustration of the light source assembly of FIG. 2, according to one embodiment of the present invention.

Continuing to refer to FIGS. 2-4 showing light source assembly 12 in greater detail, in one example, perimeter framework 20 of light source assembly 12 provides circumferential or otherwise encompassing support for the plurality of light strips 26. While perimeter framework 20 may be provided as a single piece, in one example, perimeter framework 20 includes a first housing member 30 and a second housing member 32 nested together to collectively form perimeter framework 20 as shown in the exploded view of light source assembly 12 in FIG. 4. While illustrated as being circular in shape, in other embodiments, perimeter framework 20 may have a general shape that is ovular, rectangular, or otherwise shaped to extend substantially around central hub 22 in a substantially continuous and encompassing manner.

Figure 5:
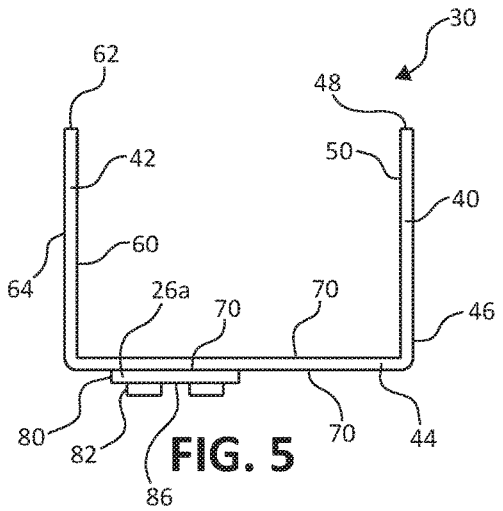
FIG. 5 is cross-sectional view illustration of a first housing member of the light source assembly taken along the line X-X in FIG. 4, according to one embodiment of the present invention.

Referring primarily to FIGS. 4 and 5, in one embodiment, first housing member 30 is a bottom, housing portion of perimeter framework 20 and includes an exterior sidewall 40, an interior sidewall 42, and a bridge, bottom or intermediate wall 44. Exterior sidewall 40 defines a first primary or exterior-facing surface 46 facing away from a center of perimeter framework 20 about the outer perimeter of first housing member 30. Exterior-facing surface 46, more particularly, extends downwardly from a circular top edge 48 of exterior sidewall 40 and is curvilinear, in one example, substantially continuously extending around an outer perimeter of perimeter framework 20.

Exterior sidewall 40 additionally includes a second primary or interior-facing surface 50 facing toward a center of perimeter framework 20 opposite exterior-facing surface 46. In one example, only a minor material thickness separates exterior-facing surface 46 from interior-facing surface 50. In one embodiment, interior sidewall 42 extends similarly to, but radially inset from, exterior sidewall 40, for example, in a manner concentric with exterior sidewall 40. Interior sidewall 42 defines a first primary or exterior-facing surface 60 facing away from a center of perimeter framework 20 toward exterior sidewall 40. Exterior-facing surface 60, more particularly, in one example, extends downwardly from a circular top edge 62 of interior sidewall 42 and is curvilinear. Interior sidewall 42 additionally includes a second primary or interior-facing surface 64 facing toward a center of perimeter framework 20 opposite exterior-facing surface 60.

In one example, interior sidewall 42 includes indentures or cutouts 66 each extending from top edge 62, toward intermediate wall 44, into an interior of interior sidewall 42. Each cutout 66 is sized to at least partially receive another portion of light source assembly 12, as will be further described below. In one embodiment, only a material thickness separates exterior-facing surface 60 from interior-facing surface 64.

Intermediate wall 44 extends between edges of exterior sidewall 40 and interior sidewall 42 opposite top edge 48 and top edge 62, respectively, giving first housing member 30 a U-shaped cross-sectional profile, in one embodiment. In one example, first housing member 30 is open opposite intermediate wall 44. Intermediate wall 44 is substantially planar with an overall circular or other suitable shape to define a bottom-facing surface 70, and an opposite, top-facing surface 72. In one embodiment, intermediate wall 44 includes wire-accommodating apertures 74 and/or fastener-receiving apertures 76 to facilitate construction of light source assembly 12.

Figure 7:
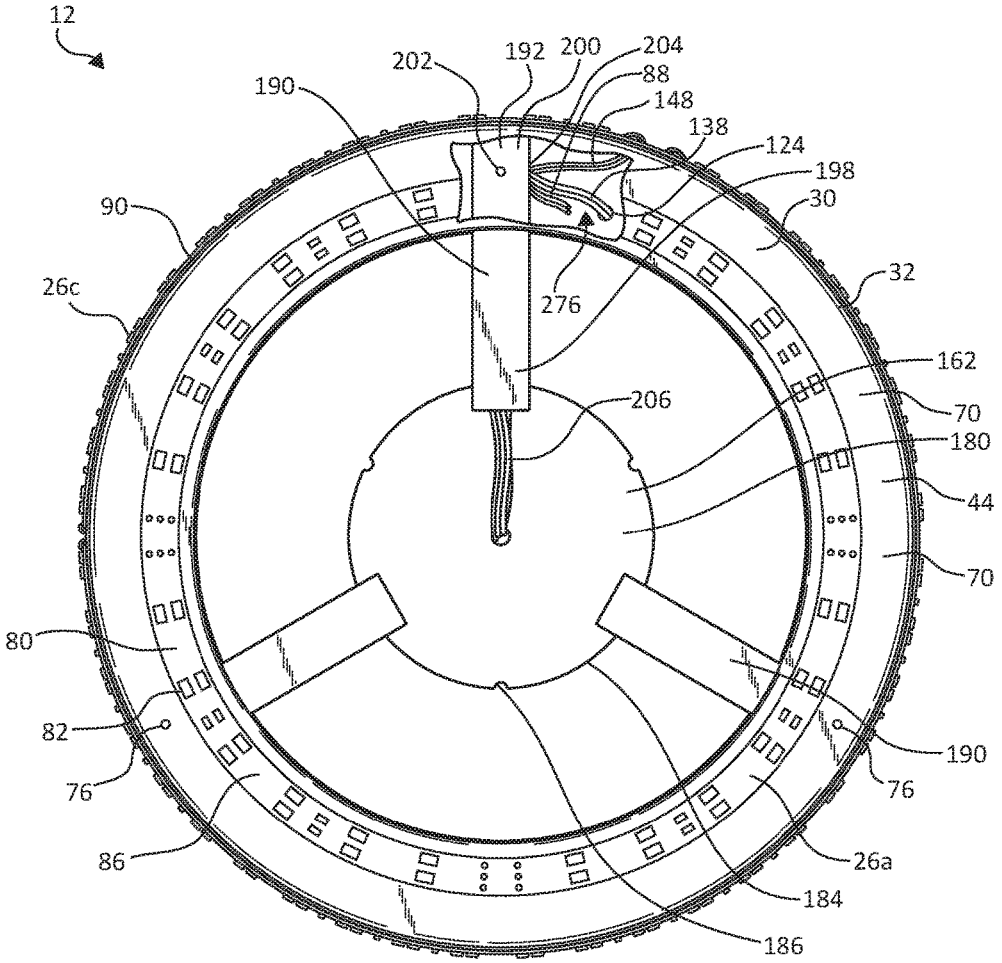
FIG. 7 is a bottom view illustration of the light source assembly of FIG. 2 with illustrative break away, according to one embodiment of the present invention.

In one embodiment, first housing member 30 includes at least one of light strips 26, for example, light strip **26*a*, coupled to bottom-facing surface 70, such that light emitted from light strip 26*a* is directed downwardly or otherwise away from bottom-facing surface 70 as illustrated with reference to FIG. 5 and the bottom view of FIG. 7. In one example, light strip 26*a* includes a printed circuit board (PCB) 80 base with light emitting diodes (LEDs) 82 or other light source mounted therein. More specifically, as illustrated in the figures, PCB 80 is annular or otherwise ring shaped defining a backing surface 84 and an opposite mounting surface 86, while in other embodiments, PCB 80 may have a different overall shape, continuous or discontinuous, corresponding with an overall shape of bottom-facing surface 70**. As used herein, "ring" refers to an encompassing or encircling assembly whether such assembly is circular (as illustrated in the drawings), ovular, rectangular, or otherwise suitably shaped.

LEDs 82 are circumferentially spaced around and secured to mounting surface 86, where PCB 80 includes the circuitry for electrically linking LEDs 82 to each other and/or a power source. Backing surface 84 faces and is coupled to bottom-facing surface 70 of first housing member 30. Light strip **26*a* additionally includes wires 88 providing electrical connectivity to light strip 26*a*. In one example, wires 88 extend from PCB 80 and through wire-accommodating aperture 74 into an interior of first housing member 30** to couple with additional wiring, a power source, etc.

Figure 6:
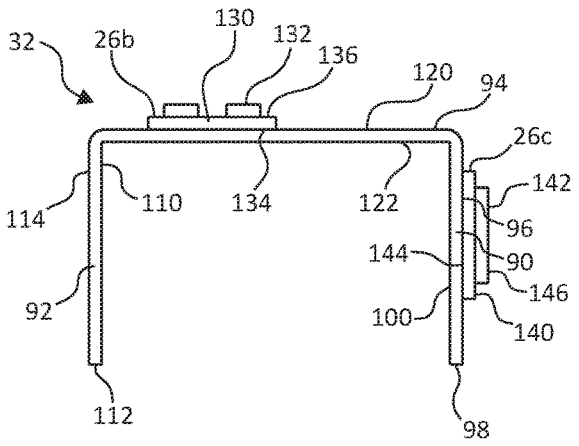
FIG. 6 is cross-sectional view illustration of a first housing member of the light source assembly taken along the line Y-Y in FIG. 4, according to one embodiment of the present invention.

Referring primarily to FIGS. 4 and 6, in one embodiment, second housing member 32 is a top housing portion of perimeter framework 20 and includes an exterior sidewall 90, an interior sidewall 92, and a bridge, bottom, or intermediate wall 94. Exterior sidewall 90 defines a first primary or exterior-facing surface 96 facing away from a center of perimeter framework 20 about the outer perimeter of second housing member 32. In one example, exterior sidewall 90 has a slightly larger diameter than exterior sidewall 40 such that exterior sidewall 90 fits around exterior sidewall 40. Exterior-facing surface 96, more particularly, extends upwardly from a circular bottom edge 98 of exterior sidewall 90, is curvilinear, and substantially continuously extends around an outer perimeter of perimeter framework 20. Exterior sidewall 90 additionally includes a second primary or interior-facing surface 100 facing toward a center of perimeter framework 20 opposite exterior-facing surface 96. In one example, only a material thickness separates exterior-facing surface 96 from interior-facing surface 100.

In one embodiment, interior sidewall 92 extends similarly to but radially inset from exterior sidewall 90, for example, in a manner concentric with exterior sidewall 90. In one example, interior sidewall 92 has a smaller diameter than interior sidewall 42 such that interior sidewall 92 fits around interior sidewall 42. As such, interior sidewall 92 defines a primary or exterior-facing surface 110 curvilinearly facing away from a center of perimeter framework 20 toward exterior sidewall 90. Exterior-facing surface 110, more particularly, extends upwardly from a circular bottom edge 112 of interior sidewall 92 and is curvilinear, in one example. Interior sidewall 92 additionally includes a second primary or interior-facing surface 114 facing toward a center of perimeter framework 20 opposite exterior-facing surface 110.

In one example, interior sidewall 92 includes indentures or cutouts 116 each extending from bottom edge 112, toward intermediate wall 94, into an interior of interior sidewall 92 and being sized to at least partially receive another portion of light source assembly 12, as will be further described below. As illustrated, cutouts 116 are equal in number to cutouts 66 and are substantially identical in circumferential spacing about interior-facing surface 114 as compared to circumferential spacing of cutouts 66 about interior-facing surface 114. In one embodiment, only a material thickness separates exterior-facing surface 110 from interior-facing surface 114.

Figure 14:
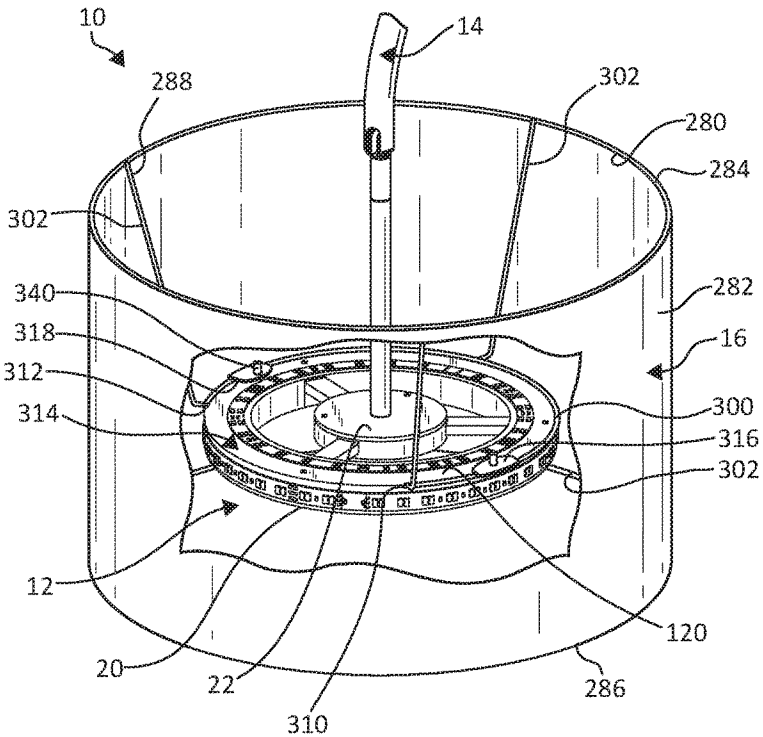

Intermediate wall 94 extends between edges of exterior sidewall 90 and interior sidewall 92 opposite bottom edge 98 and bottom edge 112, respectively, giving second housing member 32 an inverted, U-shaped cross-sectional profile, in one embodiment. In one example, second housing member 32 is open opposite intermediate wall 94. Intermediate wall 94 is generally planar with an overall circular or other ring shape to define a top-facing surface 120, and an opposite, bottom-facing surface 122. In one embodiment, intermediate wall 94 includes one or more of wire-accommodating apertures 124 and fastener-receiving apertures 126 to facilitate assembly of light source assembly 12 and/or shade coupling apertures 128 to facilitate coupling of shade 16 (e.g., FIGS. 1 and 14) to light source assembly 12.

Second housing member 32 includes at least one of light strips 26, for example, light strip 26*b* and light strip 26*c*. Light strip 26*b* is coupled to top-facing surface 120 such that light is directed upwardly or otherwise away from top-facing surface 120, as illustrated with reference to FIG. 6 and FIG. 4. In one example, light strip 26*b* includes a PCB 130 base with LEDs 132 or other light source mounted therein. More specifically, as illustrated in the figures, PCB 130 is annular or ring shaped defining a backing surface 134 and an opposite mounting surface 136, while in other embodiments, PCB 130 may have a different overall shape and/or be continuous or discontinuous to correspond with an overall shape of top-facing surface 120. LEDs 132 are circumferentially spaced around and secured to mounting surface 136, where PCB 130 includes the circuitry for electrically linking LEDs 132 to each other and/or a power source. Backing surface 134 faces and is coupled to top-facing surface 120 of second housing member 32. Light strip 26*b* additionally includes wires 138 providing electrical connectivity to light strip 26*b*. In one example, wires 138 extend from PCB 130 and through wire-accommodating aperture 124 into an interior of second housing member 32.

In one example, second housing member 32 includes light strip 26*c*. Light strip 26*c* is coupled to exterior-facing surface 96 such that light is directed radially outwardly from exterior-facing surface 96, as illustrated with reference to FIG. 6 and FIG. 4. In one example, light strip 26*c* includes a PCB 140 base with LEDs 142 or other light source mounted therein. More specifically, as illustrated in the figures, PCB 140 is flexible and initially extends for a linear length defining a backing surface 144 and an opposite mounting surface 146, while in other embodiments, PCB 140 may have a different overall shape whether continuous or discontinuous. LEDs 142 are longitudinally spaced along and secured to mounting surface 146, where PCB 140 includes the circuitry for electrically linking LEDs 142 to each other and/or a power source. Backing surface 144 is positioned to face exterior-facing surface 96 and is flexed to be coupled with exterior-facing surface 96 such that light strip 26*c* extends substantially entirely around exterior-facing surface 96 of second housing member 32, for example, in a final curvilinear manner. Light strip 26*c* additionally includes wires 148 providing electrical connectivity to light strip 26*c* and extending away from PCB 140. In one example, wires 148 extend from PCB 130 and through wire-accommodating aperture 102 in intermediate wall 94 into an interior of second housing member 32 to couple with additional wiring, a power source, etc.

In one example, perimeter framework 20, for instance, each of first housing member 30 and/or second housing member 32, are formed of a material having good heat dissipating properties, such as aluminum or other suitable material. The heat dissipating properties and configuration of perimeter framework 20, e.g., open cavity 276 (FIG. 7) formed therein promote removal of heat from around LEDs 82, 132, and 142 in a manner configured to increase the reliability and lifespan of LEDs 82, 132, and 142. In one example, light source assembly 12 is further configured via placement and coupling with central hub 22 such that exterior surfaces of perimeter framework 20 are in contact with the surrounding atmosphere and are largely unblocked by other portions of light source assembly 12 to encourage heat dissipation. While specific embodiments of the first housing member 30 and the second housing member 32 are described, other configurations are contemplated and will be apparent to those of skill in the art upon reading this application.

More specifically, in one embodiment, central hub 22 is positioned concentrically with perimeter framework 20 and is coupled thereto either directly or indirectly, e.g., via spokes 190 of light source assembly 12. Referring to FIG. 4, in one embodiment, central hub 22 includes a lower cup 160, a coupling plate 162, and a cover plate 164. Lower cup 160 includes a bottom panel 166 and sidewall 168 extending substantially continuously around a perimeter of bottom panel 166, for example, from bottom panel 166 to a free edge 170 of sidewall 168. In one embodiment, sidewall 168 includes cutouts 172 extending from free edge 170 toward bottom panel 166. Each cutout 172 is posited and sized to at least partially receive one of spokes 190 therein, for instance, by having a shape substantially identical to a cross-sectional shape of one of spokes 190. In one example, two or more, or three or more, cutouts 172 are formed in sidewall 168 and are equally circumferentially spaced therein. In one example, central hub 22 additionally includes interior, protruding elements 174 defining cavities 176 therein for receiving a fastener 178, as will be further described below. Each cavity 176 is elongated, threaded, and/or extends in a direction substantially perpendicular to bottom panel 166.

Coupling plate 162 is sized and shaped substantially identically to or slightly smaller than bottom panel 166 of lower cup 160 and, in one example, defines a bottom surface 180, an opposite top surface 182, and a perimeter edge 184. Coupling plate 162 is coupled to lower cup 160 such that bottom surface 180 of coupling plate 162 sits on free edge 170 of lower cup 160. In one example, spokes 190 are secured to coupling plate 162, e.g., via welding, adhesive, or other fastening agent, and coupled to lower cup 160 at least partially via coupling plate 162. Spokes 190 may each be of any suitable, elongated shape. For example, as illustrated, spokes 190 are elongated members with a rectangular cross-sectionals shape defining a bottom wall 192, a top wall 194 opposite to and extending substantially parallel to bottom wall 192, and opposing sidewalls 196 each extending from opposing edges of and between bottom wall 192 and top wall 194. An interior end 198 of each spoke 190 nests within a different one of cutouts 172 of lower cup 160, thereby, at least partially coupling each spoke 190 to central hub 22.

Spokes 190 are also configured to couple with light source assembly 12. In one example, each spoke 190 defines an exterior end 200 opposite interior end 198 configured to nest or otherwise fit at least partially in at least one of cutout 66 of first housing member 30 and cutout 116 of second housing member 32. Each spoke 190, or at a portion of at least exterior end 200 thereof, is sized and shaped substantially identically to each of cutouts 66 and/or 116 to snugly nest therein. In one example, each spoke 190 includes an aperture 202 extending through bottom wall 192 and/or source assembly top wall 194 to further facilitate coupling of spokes 190 to light source assembly 12. In one embodiment, at least one of spokes 190 includes wire-reception aperture 204, in one of opposing sidewalls 196, near exterior end 200, allowing wires 88, 138, and/or 148 to pass through the respective sidewall 196 and into cavity 206 of perimeter framework 20 as generally illustrated through the cut away of intermediate wall 44 in FIG. 7.

In one example, shaft 24 is coupled to coupling plate 162 via weld, adhesive, threaded coupling, or other suitable fastening member or agent. More specifically, shaft 24 is elongated including a first end 210 and an opposite second end 212 and extends substantially continuously therebetween. Shaft 24 is formed via a sidewall 214 with any suitable shape, such as a circular, rectangular, triangular, or other cross-section. Shaft 24 is hollow defining an internal cavity 216 therein to allow for passage of wires 88, 138, and 148 or extensions therethrough to support structure 14 and/or a power source.

In one embodiment, central hub 22 includes a cover plate 164, which generally improves the aesthetics of light fixture 10. In other embodiments, cover plate 164 is eliminated. Cover plate 164 is, in one example, sized substantially identically to bottom panel 166 of lower cup 160. Cover plate 164 is substantially planar defining a bottom surface 220, and opposite top surface 222, and a perimeter edge 224 defined between bottom surface 220 and top surface 222. Cover plate 164 defines a central aperture 226 sized and shaped to snugly receive shaft 24. In one example, cover plate 164 includes apertures 228 near perimeter edge 224 to facilitate coupling cover plate 164 with lower cup 160.

Assembling light source assembly 12 includes, in one embodiment, placing spokes 190, which are secured to coupling plate 162 of central hub 22, to fit at least partially within cutouts 66 of first housing member 30 of perimeter framework 20. In one embodiment, the number of spokes 190 is equal to the number of cutouts 66, and a different one of spokes 190 nests within each cutout 66, such that exterior end 200 of each spoke 190 is maintained between exterior sidewall 40 and interior sidewall 42 of first housing member 30. When so positioned, apertures 202 of spokes 190 each align with a different one of fastener-receiving apertures 76. In this manner, spokes 190 extend radially inwardly from first housing member 30 of perimeter framework 20 into central hub 22, which is maintained in a position substantially centered relative to first housing member 30 via spokes 190. In one example, shaft 24, therefore, is concentrically positioned relative to first housing member 30. In this manner, light strip **26*a* extends about shaft 24 at an equal radial distance from shaft 25 about a substantial entirety of an outer circumference of first housing member 30**.

In one embodiment, second housing member 32 is coupled with first housing member 30, such as by sliding second housing member 32 over first housing member 30 or vice versa. For example, first housing member 30 and second housing member 32 are coupled in a manner aligning cutouts 116 with spokes 190 to interpose spokes 190 between intermediate wall 44 of first housing member 30 and intermediate wall 94 of second housing member 32, more particularly, within corresponding cutouts 66 and 116. To further secure first housing member 30, spokes 190, and second housing member 32 to one another, in one example, fasteners 178 are inserted into fastener-receiving apertures 76 of first housing member 30 and into apertures 202 in bottom walls 192 of each spoke 190. Similarly, in one embodiment, other ones of fasteners 178 are threadably inserted through fastener-receiving apertures 126 of second housing member 32 and into apertures 202 in top wall 194 of each spoke 190. In this manner, first housing member 30 and is further secured to second housing member 32 via spokes 190, which are each securely maintained and interposed between first housing member 30 and second housing member 32.

In one example, prior to coupling first housing member 30, second housing member 32, and spokes 190 to one another, wires 88, 138, and 148 are run from each of the plurality of light strips 26, into interiors of first housing member 30 and second housing member 32, and through a wire-reception aperture 204 into a hollow of at least one of spokes 190. Additionally turning to FIG. 7, which is a bottom view of first housing member 30, second housing member 32, spokes 190, and coupling plate 162 with a portion of intermediate wall 44 of first housing member 30 cut away for illustrative purposes, wires 88 from light strip **26*a* extend through wire-accommodating aperture 74, as described above. Wires 88 continue into a frame cavity 276 defined between intermediate walls 44 and 94 and through wire-reception aperture 204 in one of opposing sidewalls 196 of the corresponding spoke 190. Similarly, wires 38 extend through wire-accommodating aperture 124 of second housing member 32 into cavity 276 and through wire-reception aperture 204, and wires 148 extend through wire-accommodating aperture 102 in exterior sidewall 90 into frame cavity 276**.

In one example, first housing member 30 may include an aperture (not shown) aligned with wire-accommodating aperture 102 such that wires 148 extend through aligned apertures in each of first housing member 30 and second housing member 32 to reach frame cavity 276. All of wires 88, 138, and 148 are thread through wire-reception aperture 204 of spoke 190 into an interior of spoke 190, through a length of spoke 190, out interior end 198 of spoke 190, and into and through internal cavity 216 of shaft 24, according to one embodiment of the invention. In this manner, wires 88, 138, and 148 extend through and out top of shaft 24.

In one example, cover plate 164 fits over and around shaft 24, and is slid down a length of shaft 24 to fit over and cover coupling plate 162. In one embodiment, bottom surface 220 of cover plate 164 sits directly or indirectly on free edge 170 of lower cup 160, such that coupling plate 162 fits within lower cup 160 below a free edge 170 thereof, interposed between cover plate 164 and bottom panel 166 of lower cup 160. Additional fasteners 178 inserted through apertures 228 in cover plate 164, through cutouts 186 in coupling plate 162, and into cavities 176 formed within protruding elements 174 of lower cup 160 secure cover plate 164, coupling plate 162, and lower cup 160 together to collectively form central hub 22.

In one example, a shaft topper 230 is added to second end 212 of shaft 24 to facilitate coupling shaft 24 with support structure 14. In one embodiment, shaft topper 230 includes a threaded cylinder 232, a wall 234, and opposing sidebars 236. Threaded cylinder 232 is screwed into second end 212 of shaft 24, in one embodiment, with threaded cylinder 232 being substantially hollow. Wall 234 extends across an end of end of threaded cylinder 232, for example, substantially in a direction perpendicular to the elongated extension of threaded cylinder 232. Each of two opposing sidebars 236 extend from wall 234 in a direction opposite threaded cylinder 232 and spaced from one another to define a center cavity 240 with a center opening (not shown) into center cavity through wall 234. In this manner, wires 88, 138, and 148 extend through shaft 24 and through shaft topper 230 to support structure 14. In one example, each opposing sidebar 236 defines an outer bump 242 or protrusion to facilitate assembly with support structure 14 as will be further described below.

Generally LEDs, such as those that may be included in light strips 26, convert more electricity into heat than light, which often results in the generation of relatively large amounts of heat. It is generally desirable to remove heat from light source assembly 12, more specifically, from around LEDs 82, 132, and 142, to increase efficiencies, reliability, and/or life span. In one example, light source assembly 12 is designed to promote transfer of heat away from light strips 26. For instance, in one embodiment, open space within an interior of perimeter framework 20 and broad surfaces of perimeter framework 20 components, e.g. as provided by exterior sidewalls 40 and 90, interior sidewalls 42 and 92, and intermediate walls 44 and 94, provide paths for heat dissipation from light strips 26.

In one example, the material forming first housing member 30 and/or second housing member 32 is selected to further promote the conduction of heat through surfaces of perimeter framework 20. In one embodiment, first housing member 30 and second housing member 32 are formed of aluminum, which also serves to provide light source assembly 12 with a low overall weight. In one example, spokes 190 are selected and spaced to leave considerable amounts of open space between central hub 22 and perimeter framework 20 and to leave a significant amount of interior sidewall 42 in contact with the surrounding atmosphere. As such, heat conducted through interior sidewall 42 is largely dissipated to the surrounding atmosphere decreasing the temperature of the LEDs and, therefore, increasing the reliability, efficiency, and life span of light source assembly 12.

Support structure 14 may have any variety of forms, for example, forms common for conventional incandescent or fluorescent light fixtures and/or forms new to LED-based fixtures. In the embodiment illustrated in FIG. 1, support structure 14 includes a base 260 and a trunk 262. Base 260 is configured to sit on a floor or other substantially horizontal surface (not shown) providing weight and stability to light fixture 10. Trunk 262 is coupled with and extends from base 260 to light source assembly 12. In one example, trunk 262 includes a linear segment 264 extending upwardly, such as substantially vertically, from base 260, and a curvilinear segment 266 extending upwardly and forwardly from an end of linear segment 264 opposite base 260, for instance, in the shape of an arc. In one embodiment, linear segment 264 and/or curvilinear segment 266 are eliminated, as will be apparent to those of skill in the art upon reading this application.

Figure 8:
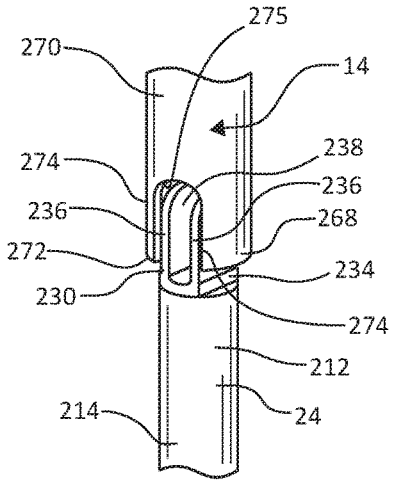
FIG. 8 is a front perspective view illustration of a coupling between the light source assembly and a support structure of FIG. 1, according to one embodiment of the present invention.

Additionally referring to the detailed view of FIG. 8, in one example, an end of support structure 14 opposite base 260, such as, a free end 268 of curvilinear segment 266, is configured to be coupled with light source assembly 12, more particularly, in one instance, shaft topper 230 (FIG. 4) thereof. Free end 268 is formed by sidewall 270 of trunk 262. In one embodiment, free end 268 defines an opening 272 to a shaft internal cavity 275 and opposing cutouts or opposing slots 274 extending from free end 268 into trunk 262 having a width configured to receive shaft topper 230, more specifically, opposing sidebars 236 thereof. Various couplings of light source assembly 12 to support structure 14 are contemplated. In the illustrated embodiment, shaft topper 230 of light source assembly 12 is received within internal cavity 275 of support structure 14 and/or is otherwise coupled to support structure 14 in an adjustable manner such that a position of light assembly 12 can be rotated about free end 268. In one embodiment, interiors (not shown) of free end 268 are configured to interact with outer bumps 242 to frictionally couple light source assembly 12 with support structure 14, which may or may not be further secured with additional fastening elements. In addition, wires 88, 138, and 148 extend through shaft topper 230, into internal cavity 275, and through trunk 262 and base 260 to an exterior power plug (not shown) as will be apparent to those of skill in the art.

In one example, the resultant light fixture 10 has LEDs 142 of light strip 26*c* emitting light radially outwardly about 360° around light source assembly 12, LEDs 82 of light strip 26*a* emitting light downwardly, and/or LEDs 132 of light strip 26*b* emitting light upwardly. In one example, light emission, such as intensity, color, duration, etc. of light strips 26*a*, 26*b*, and 26*c* are independently adjustable and, in one example, individual LEDs 82, 132, and 142 are independently or collectively adjustable. While control of light strips 26*a*, 26*b*, and 26*c* and/or LEDs 82, 132, and 142 included thereon may be via a control panel (not shown) on light fixture 10 and/or via a remote control coupled with light fixture 10, in one example, light fixture 10 additionally includes a Bluetooth chip allowing control of light strips 26*a*, 26*b*, and 26*c* and/or LEDs 82, 132, and 142 via a local computerized device, such as a mobile phone, a computer, a computerized tablet, etc. In another embodiment, light fixture 10 is linked to a network via Wi-Fi or other suitable connection such that light strips 26*a*, 26*b*, and 26*c* and/or LEDs 82, 132, and 142 are able to be controlled via another electronic device accessing the same network. Regardless of the particular means of controlling light strips 26*a*, 26*b*, and 26*c* and/or LEDs 82, 132, and 142, in one example, light strips 26*a*, 26*b*, and 26*c* and/or LEDs 82, 132, and 142 are independently controllable to change the light color, light intensity, etc. emitted by LEDs 82, 132, and 142. In one example, various preset LEDs 82, 132, and 142 group settings are programmable allowing a light emission mode or modes to be varied easily by the user, as will be apparent to those of skill in the art upon reading this application.

Figure 9:
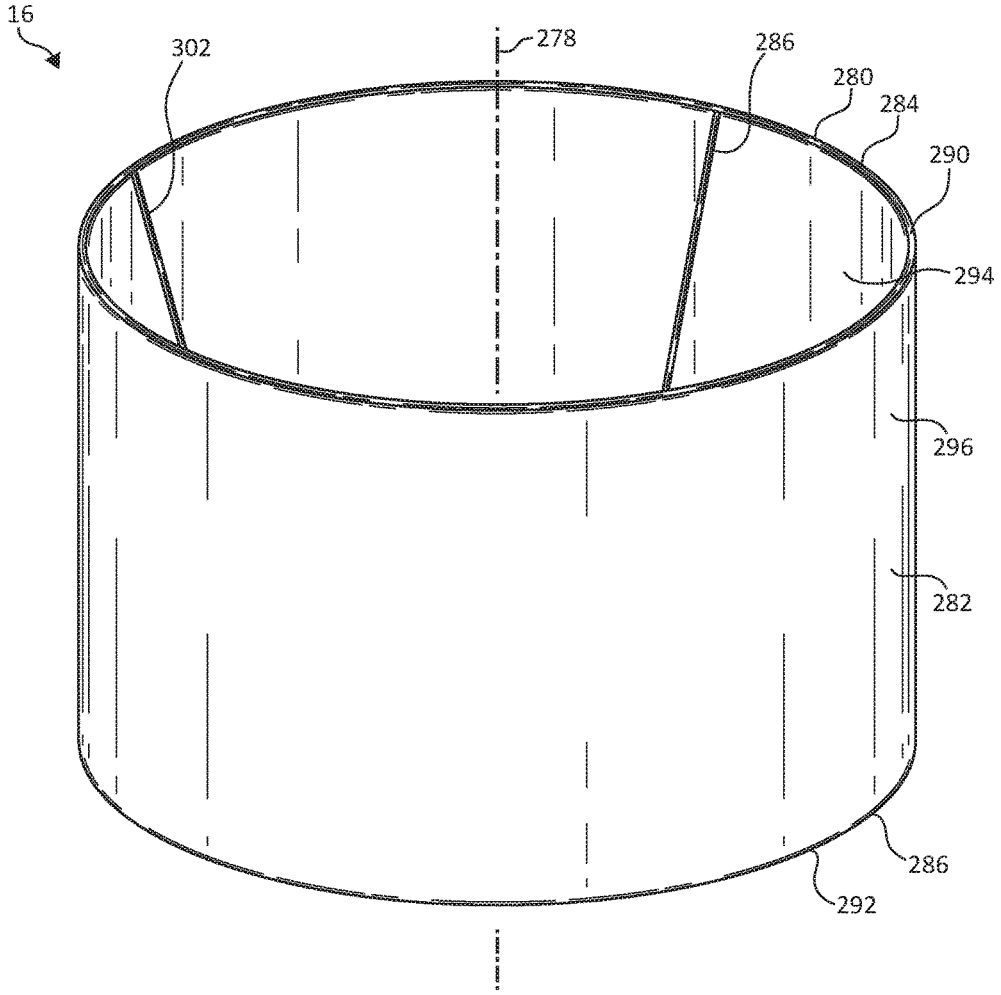
FIG. 9 is a front perspective view illustration of a shade of the light fixture of FIG. 1, according to one embodiment of the present invention.

Shade 16 is couplable with and uncouplable from the light assembly 12 in a relatively easy manner such that no disassembly of light source assembly 12 or detachment of light source assembly 12 from support structure 14 is necessary to position shade 16 for coupling with light source assembly 12. One embodiment of shade 16 is illustrated in FIG. 9 and includes a frame 280 and trimming 282. Frame 280 provides the support or skeleton to shade 16 giving shade 16 its overall size and shape. Trimming 282 generally provides the body of shade 16 and is supported by frame 280.

Figure 10:
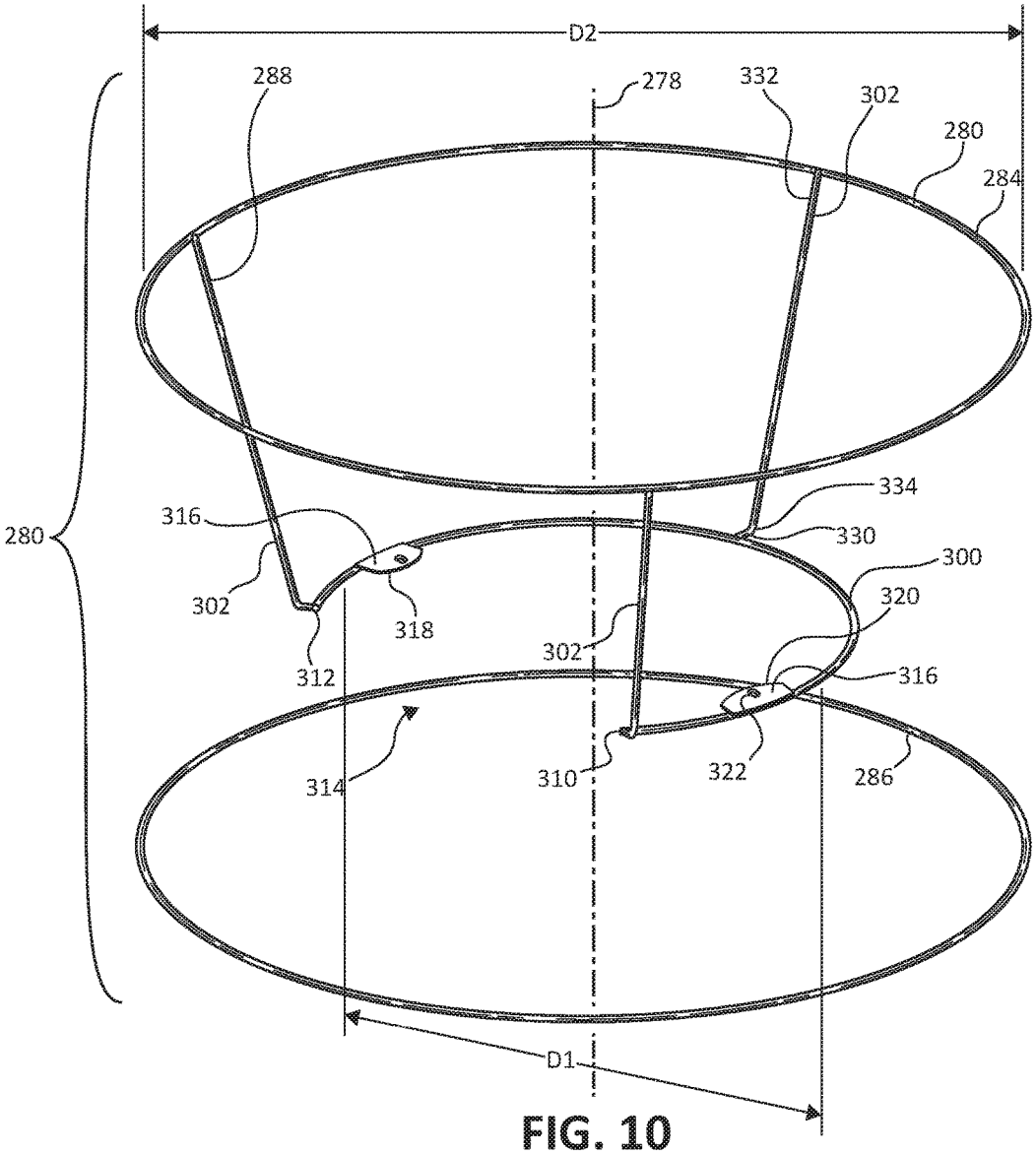
FIG. 10 is a front perspective view illustration of a frame of the shade of FIG. 9, according to one embodiment of the present invention.

FIG. 10 illustrates frame 280 with trimming 282 removed therefrom, according to one embodiment of the present invention. Frame 280, in one example, is formed of any suitable, substantially rigid material, such as metal, and includes a top frame ring 284 spaced from bottom frame ring 286. As used herein, "ring" refers to an encompassing or encircling assembly whether such assembly is circular (as illustrated in the drawings), ovular, rectangular, or otherwise suitably shaped. In one example, top frame ring 284 defines a top perimeter of shade 16, and bottom frame ring 286 defines a bottom perimeter of shade. Each of top frame ring 284 and bottom frame ring 286 are substantially closed loops in any desired shape to achieve the desired aesthetic appearance of shade 16. In one example, top frame ring 284 and bottom frame ring 286 are positioned in parallel planes relative to one another and are spaced apart from one another a distance substantially equal to an overall height of shade 16.

Trimming 282 is provided in the form of fabric, paper, or other similar material(s) providing light diffusing or blocking characteristics to shade 16. In one example, trimming 282 includes a top edge 290 and a bottom edge 292 opposite top edge 290. Top edge 290 is sized to correspond with top frame ring 284, and top edge 290 of trimming 282 is wrapped around, adhered to, and/or otherwise secured to top frame ring 284. Similarly, bottom edge 292 of trimming 282 is sized to correspond with bottom frame ring 286 and is wrapped around and/or adhered and/or otherwise secured to bottom frame ring 286. In one example, trimming 282 defines an interior liner 294 and an outer covering 296 substantially coextensive with each other, as will be apparent to those of skill in the art upon reading this application.

In one example, interior liner 294 is formed of plastic or other suitable material enhancing diffusive qualities of shade 16 and providing structural shape and support to shade 16 as it extends between top edge 290 and bottom edge 292 of trimming 282. In one example, trimming 282 also couples bottom frame ring 286 and top frame ring 284 to one another, maintains spacing of bottom frame ring 286 and top frame ring 284 and, in one instance, maintains bottom frame ring 286 and top frame ring 284 to each extend in substantially parallel planes relative to each other. Covering 296 enhances aesthetic appeal, e.g., texture, color, print, etc. and/or diffusive properties of shade 16 and, in one example, covers an exterior facing surface (not shown) of interior liner 294.

FIG. 10 illustrates frame 280 with trimming 282 removed for illustrative purposes, according to one embodiment of the present invention. In the illustrated embodiment, frame 280 additionally includes a spider element 288 for facilitating coupling shade 16 to light source assembly 12. In one example, top frame ring 284 is coupled to a spider element 288 for coupling shade 16 to light source assembly 12. Spider element 288 generally extends radially inwardly from top frame ring 284 to interface with light source assembly 12. Spider element 288 includes a coupling ring 300 and arms 302. Coupling ring 300 is configured to be selectively coupled with light source assembly 12, and arms 302 radially extend from coupling ring 300 to secure coupling ring 300 to top frame ring 284.

In one example, coupling ring 300 is an elongated member formed of a substantially rigid material such as a metal rod or other suitable material, extending from a first end 310 to an opposite second end 312. Coupling ring 300 is bent or flexed into a partially, but not entirely, closed shape, e.g., a circle, square, oval, polygon, etc., continuously formed as coupling ring 300 extends from first end 310 to second end 312. In one embodiment, coupling ring 300 has a substantially identical overall shape as perimeter framework 20 and is sized to fit around a portion of exterior facing surface 60 of second housing member 32. In one example, coupling ring 300 is formed such that first end 310 and second end 312 do not meet or overlap one another and such that an opening 314 is defined between first end 310 and second end 312 as a gap in the otherwise closed formation of coupling ring 300. In this manner, coupling ring 300 has an open shape. Opening 314 is at least large enough to allow shaft 24 of light source assembly 12 to pass therethrough, as will be further described below.

In one example, coupling ring 300 is closed about an angle of at least 225°, with an angle of opening 34, as measured about a center axis of coupling ring 300 between first end 310 and second end 312, being equal to between about 30° and about 135°, and in one example, between about 60° and about 120°. In one example, coupling ring 300 is closed over an angle at least greater than 180° such that the curvature or otherwise formed perimeter of coupling ring 300 facilitates alignment of shade 16 on light source assembly 12 and registration thereof in each of at least two directions.

In one embodiment, two or more coupling plates 316 are secured to coupling ring 300. More specifically, in one example, a bottom surface of each coupling plate 316 is secured to a topside of coupling ring 300. Each coupling plate 316 extends radially inwardly from coupling ring 300 to an interior edge 320 of coupling plate 316, in one example. Each coupling plate 316 is formed separately from and spaced from the other one of coupling plate 316. In one example, coupling plates 316 are positioned about 180° apart from each other. Each coupling plate 316 includes an opening 322 to facilitated attachment of coupling ring 300 to light source assembly 12. In other embodiments, coupling plates 316 are eliminated.

Arms 302 of spider element 288 extend radially outwardly and upwardly from coupling ring 300 to top frame ring 284. For example, each arm 302 includes a first arm end 330 and a second arm end 332. Each first arm end 330 is secured to coupling ring 300 and each second arm end 332 is secured to top frame ring 284, for example, via welding, adhesive, or other suitable fastening means. In one example, each arm 302 includes a bend 334 at an end of a radially extending portion of first arm end 330 opposite coupling ring 300 introducing an upward inclination to the corresponding arm 302 that linearly extends to top frame ring 284. According to one embodiment, arms 302 place coupling ring 300, for example, along a common central axis 276 with top frame ring 284, bottom frame ring 286, and/or trimming 282 and in a lower position than top frame ring 284. In one example, arms 302 further maintain coupling ring 300 in a vertical position between top frame ring 284 and bottom frame ring 286, for instance, about half way between top frame ring 284 and bottom fame ring 286. In one example, coupling ring 300 is positioned in a middle third of a height of shade 16 as measured between bottom frame ring 286 and top frame ring 284.

As will be described below, the position of coupling ring 300 within shade 16 directly corresponds to the eventual position of light source assembly 12 in shade 16, in one embodiment. Arms 302 are circumferentially spaced around frame 280, for example, substantially equally spaced around frame 280 at about 120° from each other. Arms 302 provide much of the structure to shade 16 holding top frame ring 284 in position relative to coupling ring 300, which will eventually be coupled to and supported by light source assembly 12. In one embodiment, coupling ring 200 defines an interior diameter D1 (either under the standard definition for a circular shape or as referring to the largest interior diameter thereof for a non-circular shape), that is, greater than about 40%, for example, at least about 60%, of an interior diameter D2 of top frame ring 284. In one example, interior diameter D1 of coupling ring 200 is greater than about 5 inches, for example, greater than or equal to about 9 inches. In one example, interior diameter D1 is slightly greater than an outside diameter of perimeter framework 20, as will be described below.

Bottom frame ring 286 is sized and shaped similar to top frame ring 284, in one embodiment, where trimming 282 (FIG. 9) extends substantially vertically around a perimeters of shade 16 between top edge 290 and bottom edge 292. In another embodiment, while bottom frame ring 286 and top frame ring 284 may or may not be formed of a similar material, bottom frame ring 286 and top frame ring 284 may be of different sizes and/or shapes relative to one another to achieve a desired aesthetic look of shade 16.

Shade 16 is coupled to light source assembly 12, as illustrated in the progressive illustrations of FIGS. 11-14, without need for even partial disassembly of either shade 16 or light source assembly 12 and, in one embodiment, without the use of tools. Due to the shape of light source assembly 12, such an objective is not as easily achieved as known in the prior art for incandescent or similar bulb-based shades and fixtures. For example, referring first to FIG. 11, to assemble shade 16 to light assembly 12 without removing light source assembly 12 from support structure 14, shade 16 is turned onto its side, for example, to be positioned at between about 75° and 115° from vertical. In addition, shade 16 is rotated about its central axis to align opening 322 of coupling ring 300 with the extension of light source assembly 12 away from shaft 24.

Figure 11:
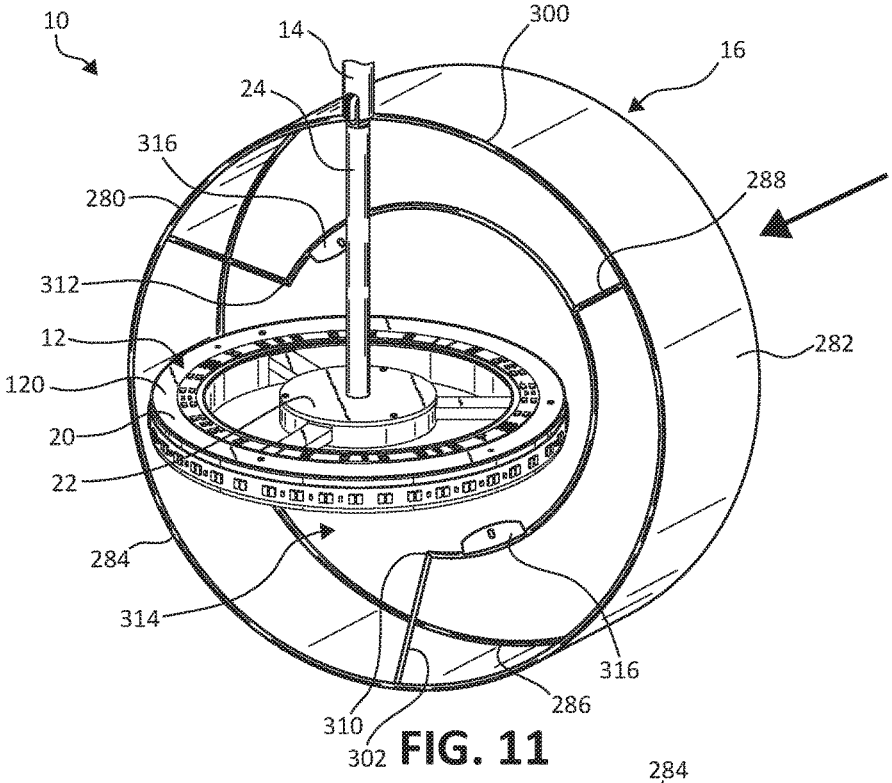
FIGS. 11-14 are front perspective view illustrations collectively showing the progression of coupling the shade of FIG. 9 with the light source assembly of FIG. 2, according to one embodiment of the present invention.

Once so positioned, shade 16 is slid toward light source assembly 12, as generally indicated by the arrow in FIG. 11. As shade 16 is slid toward source assembly 12, source assembly 12 moves through opening 322 and a central portion of shade 16 within the bounds of coupling ring 300. In one example, shade 16 is moved side-to-side to move shaft 24 off center relative to shade 16, thereby allowing light source assembly 12 to more easily pass through opening 322. Shade 16 is then moved over light source assembly 12, with perimeter framework 20 passing partially through coupling ring 300, partially past a bottom of coupling ring 300 via opening 314.

Figure 12:
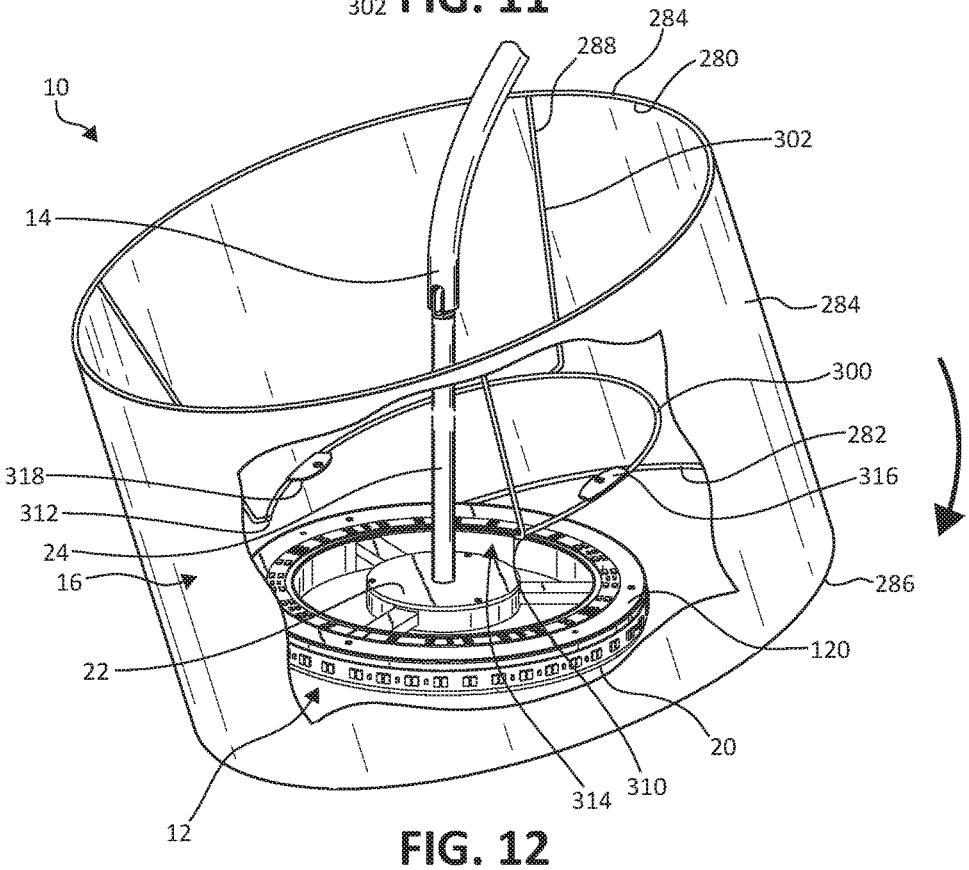
Figure 13:
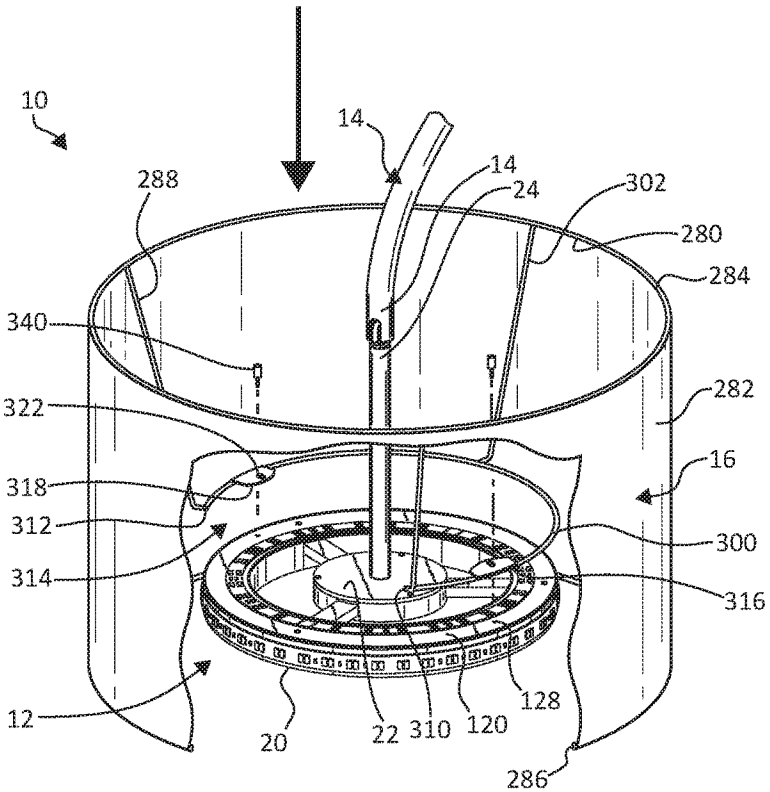

Once shade 16 is slid to a point just before shaft 24 contacts coupling ring 300, the substantially linear movement is substantially halted, and shade 16 is rotated in a substantially clockwise manner, as generally indicated by the arrow in FIG. 13, to at least partially transition light source assembly 12 entirely below coupling ring 300, via opening 314 of coupling ring 300 and open area between coupling ring 300 and trimming 282 adjacent opening 314. Rotation and continued substantially linear sliding of shade 16 maneuvers perimeter framework 20 from one side, e.g., the topside, of coupling ring 300 to a second side, e.g., the bottom side, of coupling ring 300. Once perimeter framework 20 is positioned on bottom side of coupling ring 300, shaft 24 extends upwardly through a center of coupling ring 300 to topside of coupling ring 300. Notably, since coupling ring 300 has a substantially identical overall perimeter as compared to perimeter framework 20 with light strip 26*c*, in one example, opening 322 in coupling ring 300 allows the transition of perimeter framework 20 through coupling ring 300, as illustrated in FIGS. 11 and 12.

Shade 16 is subsequently or simultaneously moved downwardly, as indicated by an arrow in FIG. 13, to sit on or around perimeter framework 20, more specifically, in one embodiment, to place bottom surface 318 of coupling plates 316 on top-facing surface 120 of intermediate wall 94 of second housing member 32. When coupling plates 316 are so aligned, in one embodiment, coupling ring 300 is positioned immediately adjacent to exterior-facing surface 110, e.g., just below top-facing surface 120. In one example, each coupling plate 316 is positioned relative to perimeter framework 20 to align opening 322 therein with shade-coupling apertures 128 in top-facing surface 120.

Thumbscrews 340 or other suitable fasteners are screwed through opening 322 and shade-coupling apertures 128 in a manner securing frame 280 of shade 16 to perimeter framework 20 of light source assembly 12. While thumbscrews 340 are the illustrated fastener for securing shade 16 to perimeter framework 20, in one embodiment, alternative fasteners are employed, such as compression clips, hooks, flaps, levers, etc. In one example, whatever fastener is employed to couple shade 16 with light source assembly 12, such fastener is engageable and releasable by a user's hands, directly on the fastener and/or on shade 16 and/or perimeter framework 20 without the use of tools. Once shade 16 is secured to perimeter framework 20, shade 16 and light source assembly 12 are each suspended from support structure 14 via shaft 24 of light source assembly 12.

In one embodiment, coupling plates 316 are eliminated and coupling ring 200 is otherwise attached to perimeter framework 20. For example, coupling ring 200 be sized with an overall perimeter smaller than perimeter framework 20, and coupling ring 200 is secured to top-facing surface 120 of intermediate wall 94 and/or bottom-facing surface 70 of intermediate wall 44 using any suitable fastener.

Figure 15:
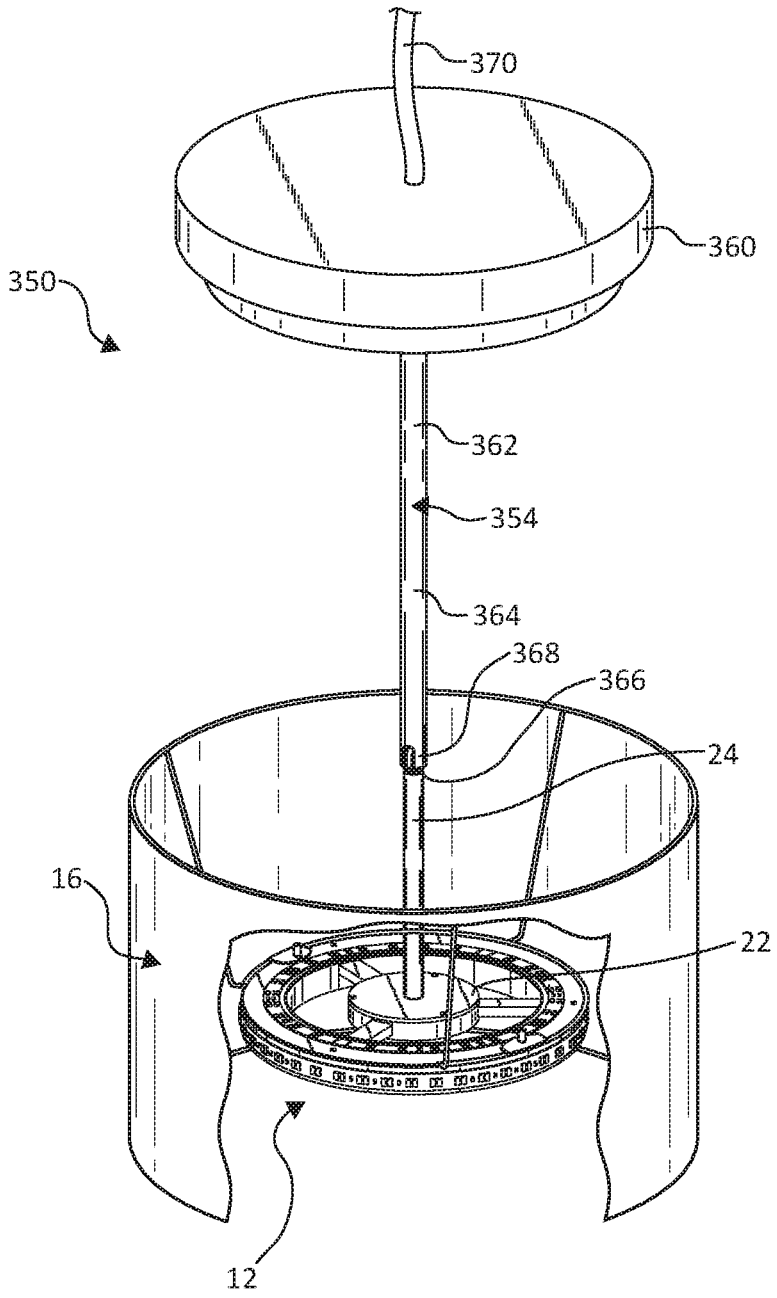
FIG. 15 is a front perspective view illustration of a light fixture incorporating the light source assembly and shade of FIG. 1, according to one embodiment of the present invention.

Light source assembly 12 and shade 16 can be used with other support structures than support structure 14 of FIG. 1. For example, FIG. 15 illustrates light source assembly 12 and shade 16 on a pendant support structure 354 suspended from a ceiling (not shown) or other support and collectively forming light fixture 350. Support structure 354 includes a base 360 and depending trunk 362 extending downwardly therefrom, for example. Base 360 is coupled with the ceiling and has electrical wires 379 (generally shown in FIG. 15) extending into ceiling and being coupled with a power source (not shown). Trunk 362 may be a substantially rigid elongated member and/or an extension of wires or cording. In one example, trunk 362 is primarily defined by sidewall 364 having a closed cross-sectional shape (e.g. circular, ovular, rectangular, triangular, polygonal or other suitable shape) and having an opening 366 at one end thereof. In one embodiment, sidewall 364 defines opposing slots 368, much like opposing slots 274 of trunk 262 in FIG. 8, and shaft 24 of light source assembly 12 is coupled to trunk 362 in the example of FIG. 15 in a similar manner as shaft 24 is coupled to trunk 262 in FIG. 8. Other support structures will be apparent to those of skill in the art upon reading this application.

Embodiments of the present invention provides a light source assembly using LED light sources to provide a substantially uniform emission of light in a plurality of directions while allowing for efficient heat dissipation enhancing the life span, efficiencies, etc. of the LED light sources. The present invention further provides a shade configured to ready coupling and uncoupling from light source assembly characterized by an absent of need for tools and by an ability to be coupled with light source assembly while light source assembly remains suspended or otherwise supported by a support structure.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A shade for use with a light source assembly, the shade comprising:

a frame ring;

a coupling ring configured to be secured to the light source assembly, the coupling ring including a first end and a second end opposite the first end, the coupling ring forming an open shape such that the first end and the second end are spaced from each other defining a coupling ring opening between the first end and the second end;

at least two arms each extending between the frame ring and the coupling ring to maintain the frame ring spaced from the coupling ring; and a trimming coupled to and extending around and away from the frame ring, the trimming being configured to at least one of direct light and diffuse light emitted from the light source assembly.

2. The shade of claim 1, wherein the first end and the second end of the coupling ring are spaced at least about 30° apart as measured about a center axis of the coupling ring.

3. The shade of claim 1, wherein the frame ring substantially extends in a first plane, the coupling ring substantially extends in a second plane, and the first plane and the second plane are substantially parallel to one another.

4. The shade of claim 1, wherein the frame ring forms a closed shape extending substantially in a first, single plane, and the frame ring and the coupling ring have a common central axis.

5. The shade of claim 1, wherein the trimming has a height greater than about two times a distance from the coupling ring to the frame ring.

6. The shade of claim 1, wherein the coupling ring has an outside diameter greater than about five inches.

7. The shade of claim 1, further comprising at least two coupling plates coupled to the coupling ring, wherein the at least two coupling plates are each spaced from each other and each extends radially inwardly from the coupling ring configured to be coupled with the light source assembly.

8. The shade of claim 7, wherein each of the at least two coupling plates includes an aperture for receiving a fastener to facilitate securement of the coupling ring to the light source assembly.

9. The shade of claim 1, in combination with the light source assembly, the light source assembly including an annular frame supporting a plurality of light source elements, and the coupling ring is secured to the annular frame.

10. The shade and light source assembly combination of claim 9, wherein the light source assembly includes a support rod extending along a center axis of and coupled to the annular frame, and the shade is suspended above a floor via the support rod and the light source assembly.

11. A light fixture comprising:

a light source assembly including a housing and one or more light strips, the housing defining a first primary surface, and the one or more light strips being coupled to the first primary surface; and a shade comprising:

a frame ring, a coupling ring configured to be secured to a light source assembly, the coupling ring including a first end and a second end opposite the first end, the coupling ring forming an open shape such that the first end and the second end are spaced from each other defining a coupling ring opening between the first end and the second end, at least two arms each extending between the frame ring and the coupling ring to maintain the frame ring spaced from the coupling ring, and a trimming coupled to and extending around and away from the frame ring, the trimming being configured to at least one of direct light and diffuse light emitted from the light source assembly.

12. The light fixture of claim 11, further comprising a support structure secured to the shaft opposite the light source assembly and supporting the light source assembly in a position above a floor.

13. The light fixture of claim 11, wherein:

the first end and the second end of the coupling ring are spaced at least about 30° apart as measured about a center axis of the coupling ring, the frame ring forms a closed shape extending substantially in a first, single plane, and the frame ring and the coupling ring have a common central axis.

14. The light fixture of claim 11, wherein:

the shade further comprises at least two coupling plates coupled to the coupling ring, the at least two coupling plates are each spaced from each other and each extends radially inwardly from the coupling ring, and each of the at least two coupling plate are coupled with the housing of the light source assembly.

15. The light fixture of claim 11, wherein the light source assembly includes:

a light source housing defining a first intermediate wall, a second intermediate wall, and a side wall extending between the first intermediate wall and the second intermediate wall, wherein the first intermediate wall, and a first lighting strip coupled to the first intermediate wall and including a first group of light emitting diodes facing away from the first intermediate wall.

16. The light fixture of claim 15, wherein the light source assembly includes:

a second lighting strip coupled to the second intermediate wall and including a second group of light emitting diodes facing away from the second intermediate wall, and a third lighting strip coupled to the side wall and including a third group of light emitting diodes facing away from the side wall.

17. The light fixture of claim 11, wherein the light source assembly includes:

a center hub centered within and coupled to the light source housing, and a shaft coupled to and extending away from the center hub such that a remainder of the light source assembly is suspended via the shaft.

18. A method of assembling a light fixture, the method comprising:

providing a light source assembly including a shaft and a housing, wherein the shaft is coupled to a support structure, the housing extends from an end of the shaft opposite the support structure, and the housing defines a first primary surface and includes one or more light strips;

coupling a shade to the light source assembly, the shade including:

a frame ring;

a coupling ring configured to be secured to the light source assembly, the coupling ring including a first end and a second end opposite the first end, the coupling ring forming an open shape such that the first end and the second end are spaced from each other defining a coupling ring opening between the first end and the second end;

at least two arms each extending between the frame ring and the coupling ring to maintain the frame ring spaced from the coupling ring; and a trimming coupled to and extending around and away from the frame ring, the trimming being configured to at least one of direct light and diffuse light emitted from the light source assembly;

wherein coupling the shade to the light source assembly includes tilting the shade, moving the light source assembly through the coupling ring opening to a position below the coupling ring, placing the coupling ring into contact with the housing of the light source assembly, and securing the coupling ring to the housing of the light source assembly.

19. The method of claim 18, wherein:

the shade includes coupling plates extending inwardly from the coupling ring, and securing the coupling ring to the housing includes inserting a fastener through the coupling plates and into the housing in a manner characterized by an absence of tools.

20. The method of claim 18, wherein placing the coupling ring into contact with the housing includes placing the coupling ring to extend around and immediately adjacent to an outer perimeter of the housing.

* * * * *